US006513315B1

(12) United States Patent
Alavoine et al.

(10) Patent No.: US 6,513,315 B1
(45) Date of Patent: Feb. 4, 2003

(54) METHOD, DEVICE AND INSTALLATION FOR THE CONTINUOUS DISPLACEMENT PROCESSING OF THREADS

(75) Inventors: Jean-Michel Alavoine, Toufflers (FR); Michel Vanhelle, Mouvaux (FR)

(73) Assignee: Verhaeghe Industries, Tourcoing (FR)

( * ) Notice: Subject to any disclaimer, the term of this patent is extended or adjusted under 35 U.S.C. 154(b) by 0 days.

(21) Appl. No.: 09/284,096

(22) PCT Filed: Oct. 8, 1997

(86) PCT No.: PCT/FR97/01796

§ 371 (c)(1),
(2), (4) Date: Apr. 7, 1999

(87) PCT Pub. No.: WO98/15680

PCT Pub. Date: Apr. 16, 1998

(30) Foreign Application Priority Data

Oct. 9, 1996 (FR) ..... 96 12581

(51) Int. Cl.[7] ..... D02G 1/16
(52) U.S. Cl. ..... 57/286
(58) Field of Search ..... 57/282, 283, 284, 57/285, 286, 287, 289, 290, 293, 7, 232, 241, 250, 258, 292, 295, 296, 350

(56) References Cited

U.S. PATENT DOCUMENTS 3,724,088 A 4/1973 Lefebvre et al.
3,837,186 A 9/1974 Lefebvre et al.
3,983,722 A 10/1976 Lefebvre et al.
4,064,684 A * 12/1977 Nijhuis ..... 57/35
5,135,811 A * 8/1992 White et al. ..... 428/395

FOREIGN PATENT DOCUMENTS

| | | |
|---|---|---|
| FR | 2 098 482 | 3/1972 |
| FR | 2 214 249 | 8/1974 |
| FR | 2 282 492 | 3/1976 |

* cited by examiner

*Primary Examiner*—John J. Calvert
*Assistant Examiner*—Shaun R Hurley
(74) *Attorney, Agent, or Firm*—Wolf, Greenfield & Sacks, P.C.

(57) ABSTRACT

The Apparatus for implementing the method of the invention comprises in succession, on the path of the thread (1): an air suction nozzle (3); at least one spray nozzle (4) for spraying a treatment bath; a removal chamber (5) for removing the air and excess treatment bath; and an air false-twist member (6); these four elements preferably forming a single-block assembly. In the spray nozzle (4) the treatment bath is sprayed at high pressure, e.g. of the order of $2\times10^5$ Pa to $6\times10^5$ Pa (2 bars to 6 bars) in the form of micro-droplets. After the apparatus, the installation includes finishing means (8) preferably consisting in two heater drums (10, 11) having offset axes, with the thread (1) being wound over the drums and moves over them in the form of substantially touching turns.

12 Claims, 3 Drawing Sheets

METHOD, DEVICE AND INSTALLATION FOR THE CONTINUOUS DISPLACEMENT PROCESSING OF THREADS

The present invention relates to the field of continuously treating textile threads, whether they be constituted by a plurality of continuous filaments or by discontinuous filaments of natural, synthetic, or artificial origin.

A method of continuous treatment, in particular dyeing, is known in particular from documents FR.2.098.428 and FR.2.122.708 in which wet thread that has passed through an impregnation chamber is caused to pass through a zone having a flow of air traveling therealong at a pressure which is much lower than the pressure that existed around the thread during the operation that caused it to be wetted. The low pressure zone is created in the supersonic flow of air at the outlet from a converging-diverging nozzle through which the thread passes. An improvement of that method is described in documents FR.2.219.268 and FR.2.250.421 and consists in imparting turbulence to the flow of air without rotating the thread.

According to the Applicant, that action of drying the thread by air is far from satisfactory in avoiding splashes from the treatment bath, in particular a bath of dye, on the thread leaving the apparatus and prior to being dried. In addition, when the method is put into operation, it is not easy to thread the thread through the various impregnation and drying members, and it is necessary to make use of hooks which are in the form of fine wire rods.

Document FR.2.282.492 discloses a method of continuous treatment intended mainly for treating a fiber tape by means of a false-twist member for the purpose of untwisting the tape after it has received injection of a liquid, which may be a colored liquid. In that method, at the outlet from the false-twist member, the fiber tape is surrounded by a liquid sheath which, in the preferred application, enables fibers to be bonded to the tape by adhesion.

An object of the present invention is to make it possible to treat all kinds of thread, whether constituted by fibers or continuous filaments, while avoiding uncontrolled splashing of the treatment bath, and guaranteeing that the thread is easy to put into place when starting the method.

This object is completely achieved by the method of treating thread in continuous displacement which, in characteristic manner, comprises the following successive operations, taken in the thread displacement direction:

a) a suction operation in which the thread is sucked through an air suction nozzle;

b) a spraying operation in which a treatment bath is sprayed onto the thread by means of at least one spray nozzle;

c) a removal operation in which the air and the treatment bath that has not been taken up by the thread are removed;

d) a false-twist operation in which an air false-twist member twists the thread; and e) optionally an operation of drying the thread; the spraying operation being capable of being performed either upstream or downstream from the suction operation.

In this method, and contrary to the teaching of document FR.2.098.482, there is no complete impregnation of the thread by passing through a treatment bath. Instead said treatment bath is sprayed, with the spraying being performed preferably at high pressure to force the treatment bath to penetrate into the core of the thread in displacement. The quantity of bath that is sprayed is adjusted as a function of the desired take-up rate, with the air of the suction nozzle removing surplus treatment bath. Naturally, the primary function of the air suction nozzle is to apply traction on the thread in its displacement direction, said traction making it possible, when the method is set into operation, to thread the thread without it being necessary to use mechanical means. The spraying operation while the thread is being inserted on starting the method is preferably not itself started until after the thread has been threaded.

Advantageously, the bath is a bath of dye and contains a resin including pigments. In which case, it is possible to obtain a dyed thread after the drying operation alone and without any need for steaming or thermosetting.

Another object of the invention is to provide an apparatus specially designed for implementing operations a) to d) of the above-specified method. The apparatus comprises in succession, and on the path of the thread: an air suction nozzle; at least one spray nozzle for spraying a treatment bath; a removal chamber for removing the air and the excess treatment bath; and an air false-twist member.

Another object of the invention is to propose an installation for treating thread continuously, the installation comprising, on the path of the thread and in its displacement direction: first delivery means; the above-specified apparatus; second delivery means; drying, thermosetting or steaming means, and receiver means.

The drying means preferably consist in two heating drums with offset axes, the thread being wound over said drums and moving in the form of substantially touching turns.

The present invention will be better understood on reading the following description of a preferred embodiment of an installation for dyeing thread continuously, as shown in the accompanying drawings, in which.

Figure 1:
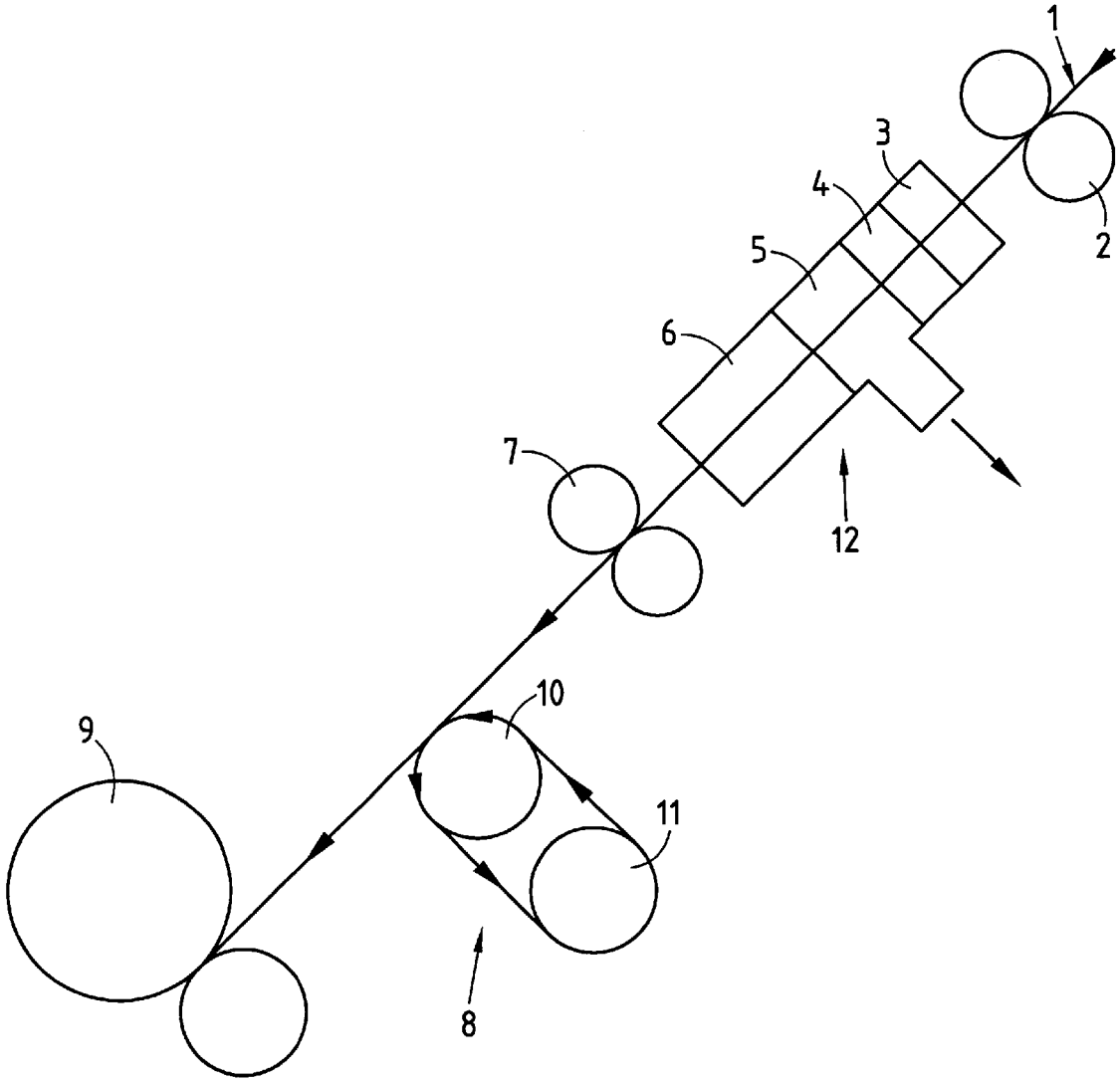
FIG. 1 is a simplified diagram of the installation.

In the treatment method of the invention, the thread 1 is subjected on its continuous displacement path to a succession of operations, namely: a suction operation by an air suction nozzle 3; a spraying operation in which a treatment bath is sprayed by means of a spray piece 4 having at least one nozzle; a removal operation in which the air and the excess treatment bath are removed by means of a removal chamber 5; a false-twisting operation by means of an air false-twist member 6; and preferably a finishing operation in a finishing station 8 prior to being received in a receiver station 9. In the example shown, the finishing station 8 is a drying station having two heater drums 10 and 11 with offset axes enabling substantially touching turns to be formed that travel continuously over the peripheral surfaces of the two drums 10 and 11. The receiver station 9 is a simple winder.

On the path of the thread, upstream from the suction nozzle 3 and downstream from the false-twist member 6, it is also possible to place respective delivery means 2, 7 each constituted by a pair of feed rollers. These delivery means make it possible to vary the instantaneous travel speeds of the thread; if the speed of the first delivery means 2 is slower than that of the second delivery means 7, then the thread 1 is put under tension or stretched; in the opposite case the thread 1 is overfed into the assembly 12 comprising the means for suction, spraying, removal, and false-twisting. Similarly, it is possible to vary the instantaneous speeds of the thread between the second delivery means 7 and the receiver means 9.

The suction nozzle 3 is constituted by a hollow piece 13 having a central channel 14 through which the thread 1 passes, an annular chamber 15 fed with compressed air by a pipe 16, and four ducts 17 connecting the annular chamber 15 to the central channel 14. These four ducts 17 are uniformly distributed around the channel 14, extending radially to the axis DD of said channel, and they are inclined in the thread displacement direction along arrow F. The compressed air coming from the pipe 16 fills the annular chamber 15 and is expelled obliquely into the central channel 14 via the ducts 17, thereby pushing the thread 1 in the direction of arrow F. It should be observed that when a free thread end is presented to the inlet 14*a* of the central channel 14, said end is naturally sucked in by the suction created by the flow of air inside the channel 14. This is what makes it easy to thread the thread through the assembly 12.

In the example shown, the structure of the spray piece 4 is similar to that described above for the suction nozzle 3, with a hollow piece 18, a central channel 19, an annular chamber 20, a feed pipe 21, and four ducts 22. The feed pipe 21 is not fed with compressed air but with a treatment bath under pressure which spreads out in the annular chamber 20 and is expelled into the central channel 19 via the ducts 22. This expulsion of liquid at high pressure via small diameter ducts causes fine droplets to be sprayed which penetrate into the core of the thread 1 passing along the channel 19.

The removal chamber 5 is constituted by a hollow piece 23 having a central channel 24 through which the thread 1 passes and a large-diameter removal pipe 25 on the side that opens out into a receptacle (not shown) with the recovered bath optionally being filtered and recycled.

Figure 2:
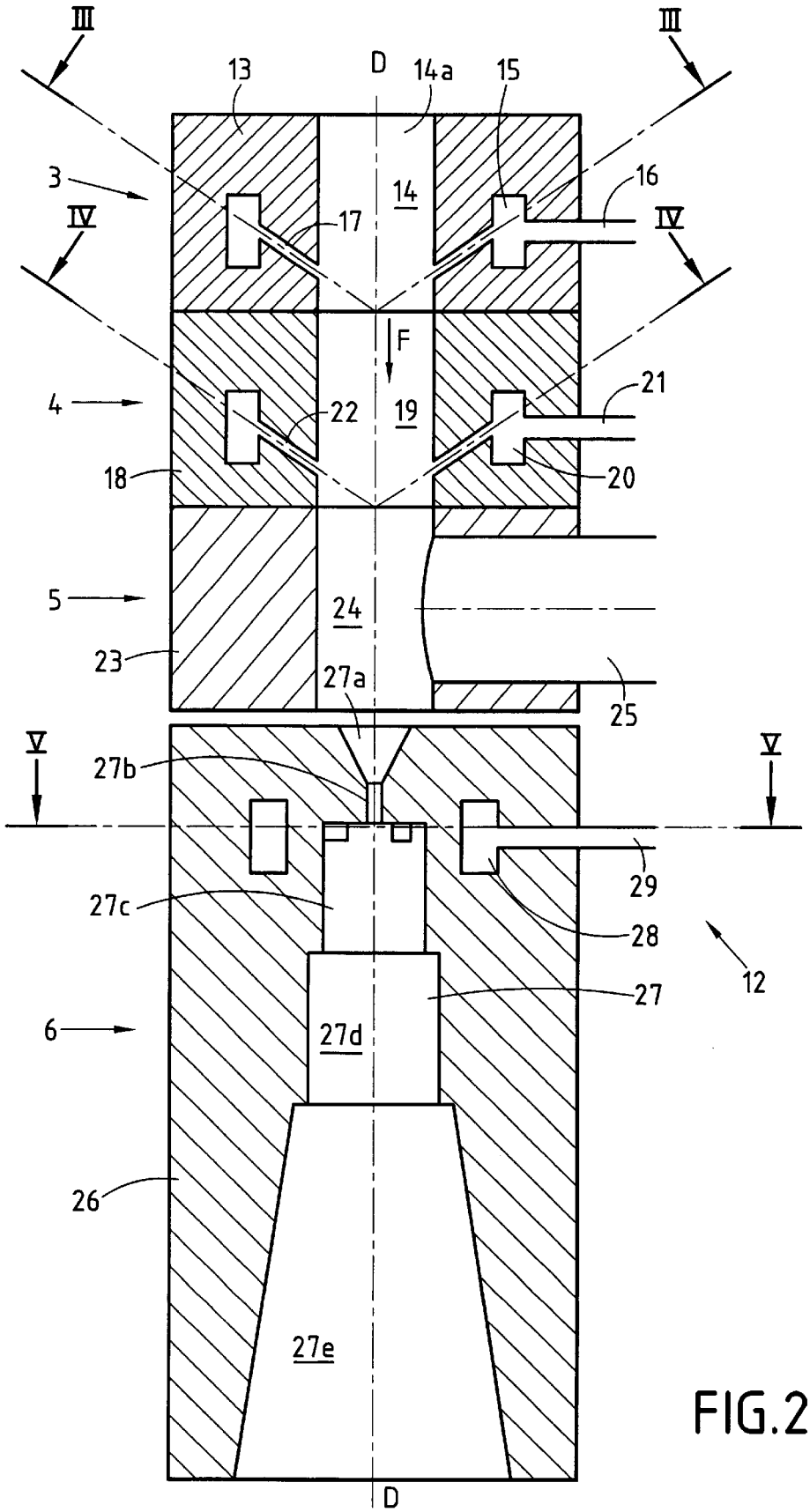
FIG. 2 is a section view of the apparatus comprising the suction nozzle, the spray nozzle, the removal chamber, and the false-twist member.
Figure 3:
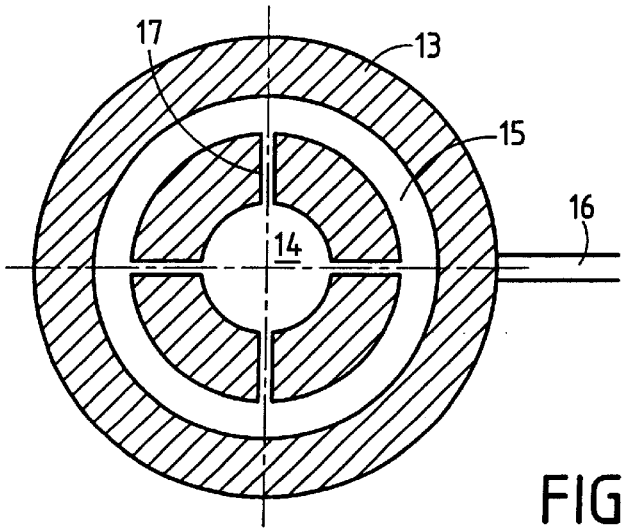
FIGS. 3, 4, and 5 are section views on lines III—III, IV—IV, and V—V of FIG. 2.
Figure 4:
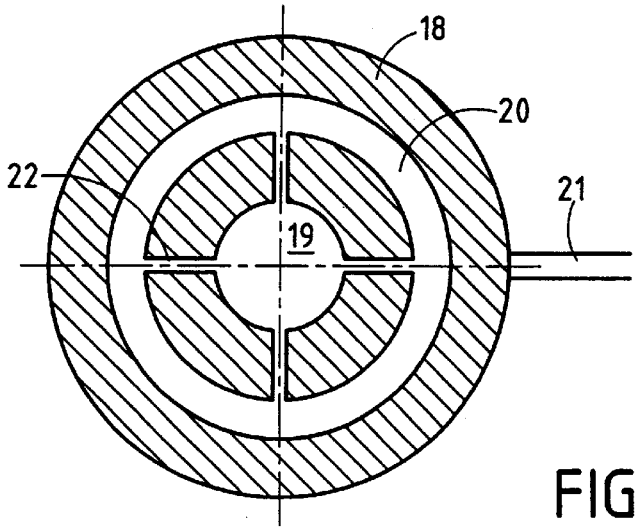
Figure 5:
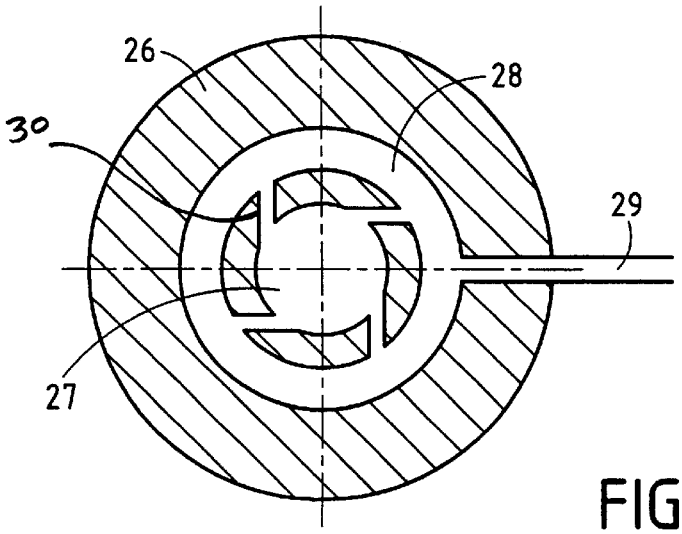

The false-twist member 6 is constituted by a hollow piece 26 with a central channel 27, an annular chamber 28 fed by a compressed air feed pipe 29 and four ducts 30 connecting the annular chamber 28 to the central channel 27. The central channel 27 as shown in FIG. 2 comprises five successive portions. The first portion 27*a* that is furthest upstream in the displacement direction of the thread along arrow F is a converging frustoconical portion. The three following portions 27*b*, 27*c*, and 27*d* are cylindrical portions having increasing diameters, and the fifth portion 27*e* is a diverging frustoconical portion. The four ducts 30 are disposed between the annular chamber 28 and the third portion 27*c* of the central channel 27 in such a manner that the compressed air penetrates tangentially relative to said channel, creating turbulent motion inside said third portion 27*c*.

The second portion 27*b* is of a small diameter which is slightly greater than the diameter of the thread 1 to be treated. Under such conditions, the air which escapes from the ducts 30 is preferentially entrained downstream, i.e. towards the portions 27*c* to 27*e*, thereby conferring a suction component to the false-twist member 6, further facilitating threading of the thread when the installation is started. The converging frustoconical shape of the first portion 27*a* is also designed to make such threading easier. In addition, the small diameter of the second portion 27*b* also serves to prevent excess treatment bath coming from the central channel 24 of the removal chamber 5 penetrating into the false-twist member 6.

The embodiment described above concerning the assembly 12 does not limit the invention. The number of ducts, their angles of inclination relative to the axis DD, their sections, and the feed pressure for each pipe all depend on the quantity of treatment bath to be deposited on the thread, on the viscosity of the treatment bath, on the displacement speed of the thread, . . . .

It would optionally be possible to interchange the suction nozzle 3 and the spray piece 4. Nevertheless, it should be observed that the apparatus as described above has a significant advantage relative to this second version, namely that the air delivered into the central channel 14 of the suction nozzle 3 in the direction of arrow F prevents droplets of the treatment bath as sprayed into the central channel 19 of the spray piece 4 from rising in the opposite direction to the displacement of the thread 1. In operation, there is therefore no leakage of treatment bath escaping via the inlet 14*a* of the channel 14 of the suction nozzle 3.

To ensure that the air and the excess treatment bath are removed under good conditions, it is important for the section of the removal pipe 25 to be greater than or at least equal to the section of the inlet orifice 14*a* of the suction nozzle 3. Similarly, the section of the central channel 19 of the spray piece 4 must be equal to or greater than that of the central channel 14 of the suction nozzle 3.

In a particular embodiment, given by way of non-exhaustive illustration, the three central channels 14, 19, and 24 had the same diameter of 5 mm and the removal pipe 25 had a diameter of 8.5 mm. The ducts 17 and 22 had a diameter of about 0.5 mm to 0.8 mm. The pressure of the compressed air feeding the suction nozzle 3 and the false-twist member 6 were respectively $3\times10^5$ Pa and $6\times10^5$ Pa (3 bars and 6 bars). The pressure feeding the treatment bath in the pipe 21 of the spray piece 4 was $4\times10^5$ Pa (4 bars) . Under those conditions, with a treatment bath having a concentration of about 100 grams per liter (g/l) of pigmented resin of the acrylic type, using a 33 tex acrylic thread at speeds of several hundreds of meters per minute, a take-up ratio was obtained of about 10% to 20% at the outlet from the assembly 12, the take-up ratio being the quantity of treatment bath taken up by the thread relative to the dry weight of the thread. In addition, the distribution of the pigmented resin over the cross-section of the thread was found to be entirely uniform. The following explanation can be given. The droplets are projected onto the thread at very high speed and they penetrate into the thread to its core; this penetration is further improved by the temporary twist caused by the false-twist member 6, which twist goes back along the thread at least as far as the removal chamber 5.

It should also be observed that passing the thread 1 through the false-twist member 6 also has the effect of mechanically wringing out the thread, which explains the low take-up ratio that can be obtained by means of the assembly 12.

In the installation shown in FIG. 1, the thread 1 leaving the assembly 12 is dried on two heater drums 10 and 11 and is then wound. The two delivery means 2 and 7 serve to adjust the instantaneous speeds of the traveling thread upstream and downstream of the assembly 12 and between the assembly 12 and the winder 9. It is therefore possible by adjusting the instantaneous speeds in this way to overfeed the thread 1 as it passes through the assembly 12. This turns out to be particularly advantageous for the treatment of non-thermoset textured multifilament threads, e.g. polyester threads. This makes it possible to avoid all of the operations that are usually desirable if it is desired to obtain a textured thread that is particularly voluminous and bulky. According to the Applicant, using the installation of the invention on this type of product gives results that are better than hank dyeing. Using different localized speeds as above turns out to be particularly advantageous for maintaining a crimp or elastic effect on a given thread.

For reasons of ease of assembly and also of interaction between the various elements, it is preferable for the assembly constituted by the suction nozzle, the spray piece, the removal chamber, and the false-twist member to be built up as a single block.

What is claimed is:

1. A method of treating a thread in continuous displacement, the method comprising the following successive steps taken in the displacement direction of the thread:

a) a suction operation in which the thread is sucked through an air suction nozzle;

b) a spraying operation in which a treatment bath is sprayed onto the thread by at least one spray nozzle;

c) a removal operation in which the air and the treatment bath that has not been taken up by the thread are removed; and d) a false-twist operation in which an air false-twist member twists the thread;

the spraying operation being performed either upstream or downstream from the suction operation and performed upstream from the false-twist operation.

2. The method according to claim 1, wherein in the spraying operation, the treatment bath is sprayed at a pressure in the range of $2\times10^5$ Pa to $6\times10^5$ Pa.

3. The method according to claim 1, wherein while the thread is being inserted on staring the method, the spraying operation is not put into operation until after the thread has been threaded.

4. The method according to claim 1, wherein the treatment bath contains a resin including pigments.

5. The method according to claim 1, further comprising an operation of drying the thread.

6. An apparatus for treating a thread in continuous displacement, the apparatus comprising in succession on the path of the thread: an air suction nozzle adapted to apply suction to the thread; at least one spray nozzle adapted to spray a treatment bath onto the thread; a removal chamber for removing the air and the excess treatment bath; and an air false-twist member.

7. The apparatus according to claim 6, wherein the air suction nozzle comprises a hollow piece comprising a central channel for passing the thread, an annular chamber fed with compressed air by a pipe, and a plurality of ducts connecting the annular chamber to the central channel, said ducts being disposed radially about a longitudinal axis of the central channel and being inclined in the direction of thread displacement.

8. The apparatus according to claim 6, wherein the spray nozzle comprises a hollow piece comprising a central channel for passing the thread, an annular chamber fed with the treatment bath under pressure by a pipe, and a plurality of ducts connecting the annular chamber radially to the central channel.

9. The apparatus according to claim 6, wherein the removal chamber comprises a hollow piece comprising a central channel for passing the thread, the removal chamber further comprising a side removal pipe, wherein the section of the side removal pipe is greater than or equal to the inlet section for the thread into the air suction nozzle.

10. The apparatus according to claim 6, wherein the air suction nozzle, the spray nozzle, the removal chamber, and the false-twist member form a single block assembly.

11. An installation for treating thread in continuous displacement, the installation comprising, on the path of and in succession in a displacement direction of the thread: first delivery means; an air suction nozzle adapted to apply suction to the thread; at least one spray nozzle adapted to spray a treatment bath onto the thread; a removal chamber for removing the air and the excess treatment bath; an air false-twist member; second delivery means; finishing means; and receiver means.

12. The installation according to claim 11, wherein the finishing means includes two heater drums with offset axes, the thread adapted to be wound over said drums and moving in the form of substantially touching turns.

* * * * *